US005603488A

United States Patent [19]

O'Rourke et al.

[11] Patent Number: 5,603,488

[45] Date of Patent: Feb. 18, 1997

[54] RAIL ATTACHABLE RESCUE FRAME FOR RAIL BRIDGES

[75] Inventors: Michael J. O'Rourke, Beaumont; David McCashin, Edmonton, both of Canada

[73] Assignee: Surety Manufacturing & Testing Ltd., Alberta, Canada

[21] Appl. No.: 326,939

[22] Filed: Oct. 21, 1994

[51] Int. Cl.[6] ..... B66D 1/36

[52] U.S. Cl. ..... 254/334; 254/264; 182/142

[58] Field of Search ..... 254/264, 334, 254/335, 336, 337, 338; 182/142; 248/168

[56] References Cited

U.S. PATENT DOCUMENTS

| | | | |
|---|---|---|---|
| 731,079 | 6/1903 | Steiner | 254/334 |
| 1,214,104 | 1/1917 | Wingire | 254/334 |
| 1,790,243 | 1/1931 | Nilson | 254/337 X |
| 2,643,856 | 6/1953 | Sales | 254/264 |
| 4,266,748 | 5/1981 | Dalton | 248/168 X |
| 4,552,339 | 11/1985 | Werners et al. | 254/335 X |
| 4,589,523 | 5/1986 | Olson et al. . | |
| 4,606,430 | 8/1986 | Roby et al. . | |
| 4,997,152 | 3/1991 | Wagman et al. | 248/168 |
| 5,147,013 | 9/1992 | Olson et al. . | |
| 5,284,324 | 2/1994 | Bunger | 254/334 X |

FOREIGN PATENT DOCUMENTS 2093958 10/1993 Canada .

OTHER PUBLICATIONS

Butco, The Universal Tripod.

*Primary Examiner*—Daniel P. Stodola
*Assistant Examiner*—Emmanuel M. Marcelo
*Attorney, Agent, or Firm*—Sixbey, Friedman, Leedom & Ferguson

[57] ABSTRACT

A rail bridge rescue frame comprises three elongated legs having upper and lower ends. The upper ends are secured to a head assembly so as to universally pivot with respect thereto. Two of the legs are forward legs of shorter and similar length and the third is a rear leg of longer length. Means are secured to the lower end of each of the forward legs to bear against a side portion of a rail. Means are attached to the lower end of the rear leg to secure to a portion of a rail. The frame is constructed so that when the rear leg is secured to one rail of a railway and the lower ends of the forward legs are bearing against outer portions of an adjacent rail thereof, the head assembly will be positioned clear of the railway to one side to provide support for a line to lift a person or the like below the railway up to the level of the railway.

13 Claims, 2 Drawing Sheets

RAIL ATTACHABLE RESCUE FRAME FOR RAIL BRIDGES

FIELD OF THE INVENTION

The present invention relates to a rail bridge rescue frame designed to be used as an anchorage support by railway bridge workers for hoisting an incapacitated worker (or the like) from below the bridge deck, to safety.

BACKGROUND OF THE INVENTION

Until recent years, bridge deck workers, along railways or the like, have not been required to use fall protection equipment.

Rescue of workers from a railway bridge has recently become a significant issue in view of movement to provide a higher degree of worker safety. In the past, A-frame type structures (bi-pods) have typically been used in cliff rescue to redirect a rope over an edge to reduce edge friction on that rope. These setups were often even improvised at the site.

More recently, as illustrated for example in U.S. Pat. No. 4,606,430 of Roby et al. and co-pending application Ser. No. 08/246,484 filed May 19 1994, fall protection anchors have been developed which secure to a rail of a railway. Such anchors are typically installed away from the bridge deck surface, because it is necessary to provide clearance or an envelope of safety for passing traffic.

Other references of general background interest relating to apparatus for moving or retrieving persons using a hoist arrangement include U.S. Pat. Nos. 4,589, 523 of Olson et al. issued May 20, 1986 and 5,147,013 of Olson et al. issued Sep. 13, 1992, and Canadian Patent Application No. 2,093, 958 of Bell published Oct. 21, 1993.

If a worker, tethered to a rail fall protection anchor, falls off of the bridge so that that worker is suspended below the bridge deck, it becomes extremely desirable to provide a rescue system which will permit unobstructed hoisting of that worker, from a position beyond the end of the railway ties of the bridge. It is a primary object of the present invention to accomplish this task.

SUMMARY OF THE INVENTION

In accordance with the present invention there is provided a rail bridge rescue frame. The frame comprises three elongated legs having upper and lower ends. The upper ends are secured to a head assembly so as to universally pivot with respect thereto. Two of the legs are forward legs of shorter and similar length and the third is a rear leg of longer length. Means are secured to the lower end of each of the forward legs to bear against a side portion of a rail. Means are attached to the lower end of the rear leg to secure to a portion of a rail. The frame is constructed so that when the rear leg is secured to one rail of a railway and the lower ends of the forward legs are bearing against outer portions of an adjacent rail thereof, the head assembly will be positioned clear of the railway to one side to provide support for a line to lift a person or the like below the railway up to the level of the railway.

The frame preferably further comprises a lift means for the person consisting of for example a winch or a block and tackle. It is preferred that the legs be of double construction, each consisting of an outer leg of hollow cross-section and an inner leg of similar shaped cross-section slidable within the outer leg. It is also further preferred that cable or similar means be secured to and extend between lower portions of the forward legs to prevent those legs from spreading when the frame is in position and loaded.

The rescue frame according to the present invention enables unobstructed hoisting of a worker, tethered by a fall arrest line, after a fall has been sustained on a railway bridge, of that worker back to the bridge deck. As well, the device of the present invention, as will be described in more detail hereinafter, is extremely versatile and permits ready adaptation to other types of rescue situations.

BRIEF DESCRIPTION OF THE DRAWINGS

These and other advantages of the invention will become apparent upon reading the following detailed description and upon referring to the drawings in which.

Figure 1:
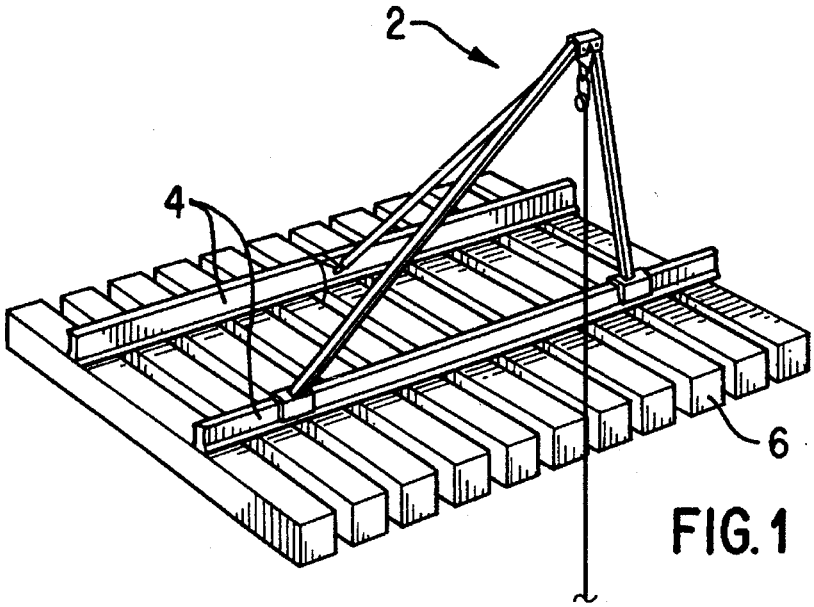
FIG. 1 is a perspective view of a rail bridge rescue frame in accordance with the present invention in position on a bridge deck for rescuing a worker from below the deck surface.

While the invention will be described in conjunction with example embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the drawings, similar features have been given similar reference numerals.

Figure 2:
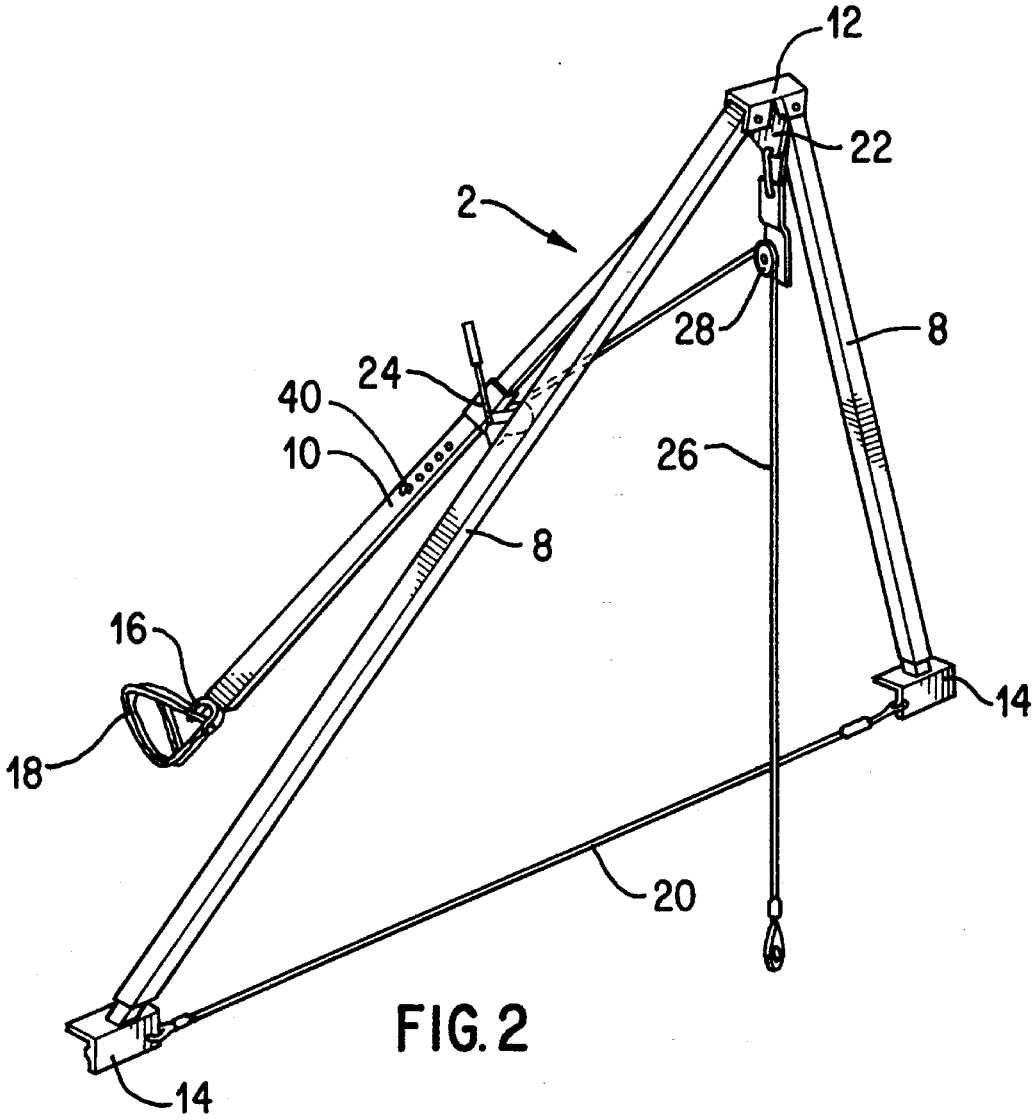
FIG. 2 is an enlarged perspective of the device of FIG. 1, showing in clear detail, features of its component parts.
Figure 3:
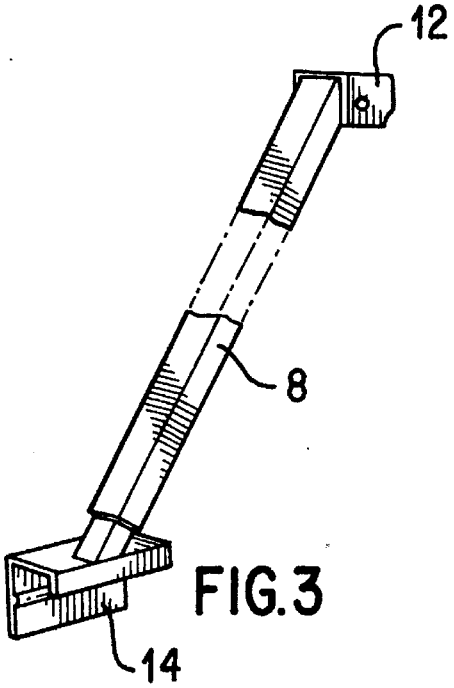
FIG. 3 is a detail perspective view of a forward leg of the device of FIG. 1.
Figure 4:
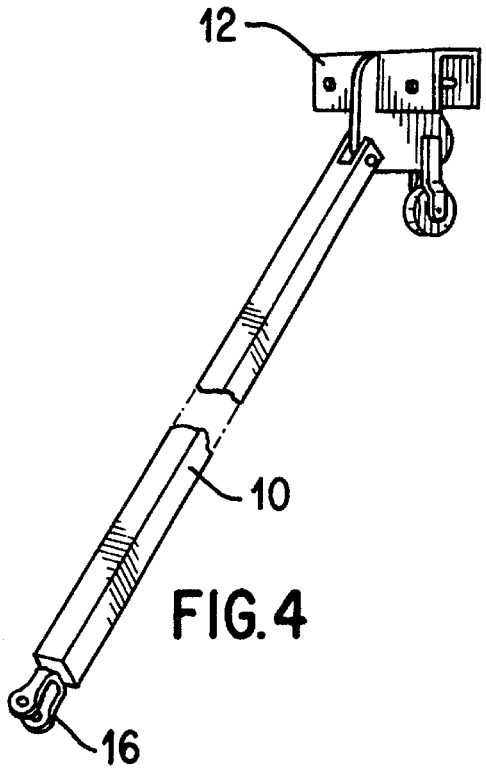
FIG. 4 is a detail perspective view of the rear leg of the device of FIG. 1.

Turning to FIG. 1 there is illustrated a rail bridge rescue frame 2 in accordance with the present invention, mounted on the rails 4 of a bridge 6, in position in cantilevered outwardly over the edge of the bridge for rescue of a worker. As can be seen in FIGS. 1 and 2, frame 2 comprises elongated forward legs 8 and a rear leg 10. The upper ends of the legs are pivotally secured to a head assembly in the form of an anchor plate 12 so as to pivot universally with respect thereto. As can be seen in FIGS. 2 and 3, legs 8 and 10 are of double construction, each consisting of an outer leg of hollow, square cross-section and inner leg of similar cross-section slidable within. As will be described in more detail subsequently, the inner and outer leg sections of rear leg 10 are adjustable, so that the length of that leg may be modified.

Secured to the lower ends of forward legs 8 are bearing plates 14, each contoured so that, when in position as illustrated in FIG. 1 (or 5), these bearing plates will bear against side portions of a rail.

To the lower end of rear leg 10 is secured a jaw shackle 16 for releasable engagement to a steel cable anchor sling 18 circumscribing a portion of a rail 4 to which the rear leg is attached. A cable 20 is secured to and extends between lower portions of forward legs 8, to prevent those legs from spreading when the frame is in position and loaded as illustrated in FIG. 1.

When in position as illustrated in FIGS. 1 and 2, with rear leg 10 adjusted to be longer in length than forward legs 8, frame 2 is cantilevered outwardly so that anchor plate 12 is positioned beyond the edge of the railway ties of the bridge 6. A block and tackle type rigging 22 may be suspended from anchor plate 12 or, as illustrated in FIG. 2, a power winch 24 can be adapted to fit on rear leg 8 with an appropriate bracket and the cable or rope 26 then passed over a pulley 28 which is attached to the anchor plate 12.

Figure 5:
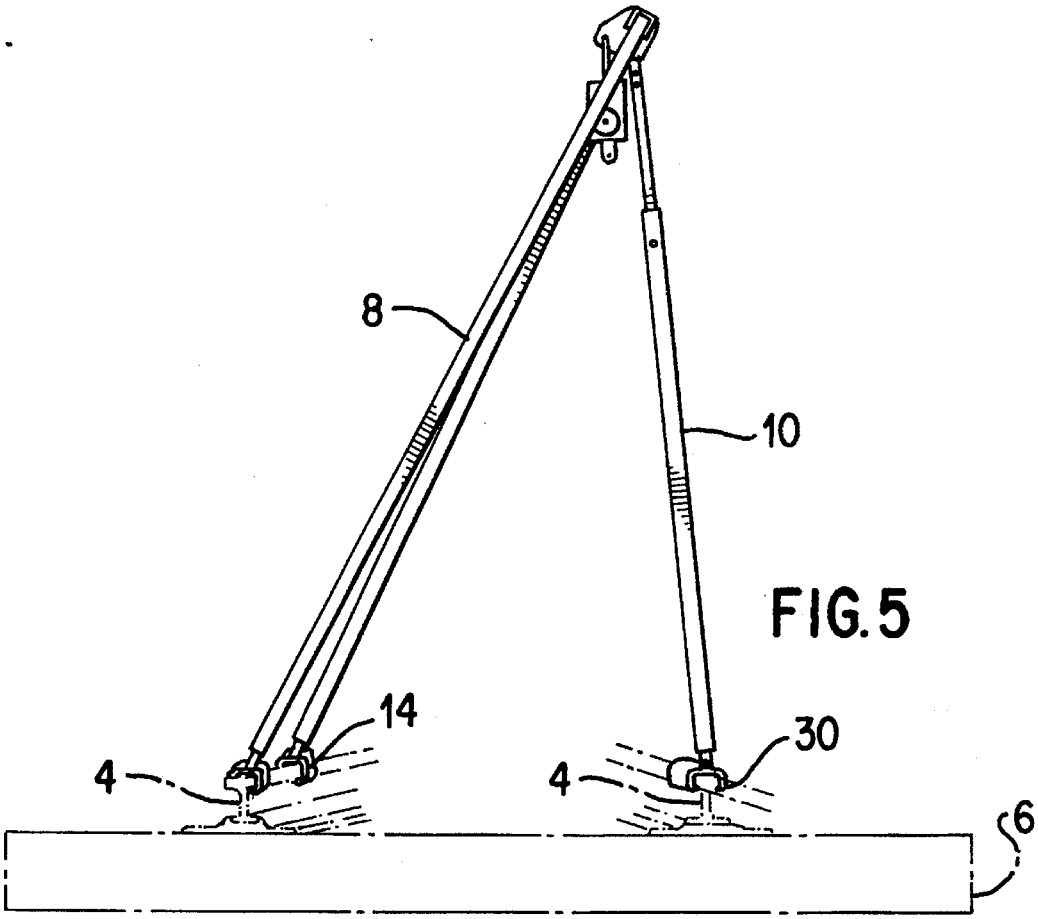
FIG. 5 is a perspective view of a rail bridge rescue frame in accordance with the present invention, adapted for use as a tripod.

To convert the frame to a more conventional tripod structure (in order to position a rescue anchor over open ties which may lie between rails 4), as illustrated in FIG. 5, the inner legs of forward legs 8 are removed and fitted back into the outer legs with the foot plates 14 rotated 180°, so that they will bear against inner sides of corresponding rail 4. As well, the inner leg of rear leg 10 is shortened within the corresponding outer leg, so that anchor plate 12 is more or less positioned between and above tracks 4. As well, the jaw shackle fitting 16, and steel cable anchorage sling which secure the bottom of rear leg 10 to a track 4 in the embodiment of FIG. 1, are replaced by a rail anchor 30, secured to the bottom of leg 10, the rail anchor having components which releasably clamp about the crown of rail 4 to secure that leg in place on the rail. The securing of the inner leg within the outer leg at a particular position, for rear leg 10, may be accomplished for example by aligning appropriate positioning holes through the inner and outer leg sections, and securing the legs in appropriate position by a pin 40.

As will be understood the cantilever design of FIG. 1 allows a significant vertical force to be applied to the anchor plate 12. The double leg design provides sufficient strength and allows some disassembly of the leg components. The foot plates 14 on the forward legs are provided in an orientation and contour to allow weight to be borne by the rail with a high degree of stability.

Thus, it is apparent that there has been provided in accordance with the invention a rail bridge rescue frame that fully satisfies the objects, aims and advantages set forth above. While the invention has been described in conjunction with (a) specific embodiment(s) thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What we claim as our invention:

1. A rail bridge rescue frame comprising three elongated legs having upper and lower ends, the upper ends secured to a head assembly so as to universally pivot with respect thereto, two of the legs being forward legs of shorter and similar length and the third being a rear leg of longer length, rail bearing means secured to the lower end of each of the forward legs and adapted to conform to a side portion of a railway rail to bear against a first rail and a rail attachment means attached to the lower end of the rear leg and adapted to circumscribe at least a portion of a railway rail for securing the rear leg to a portion of a second rail adjacent said first rail, the frame constructed so that when the rear leg is secured to said second rail and the lower ends of the forward legs are bearing against outer side portions of said adjacent first rail, the head assembly will be positioned clear of the railway to one side to provide support for lifting a line to lift a person or object below the railway up to the railway.

2. A frame according to claim 1 further comprising lift means for said person or object.

3. A frame according to claim 2 wherein the lift means comprises a winch means to raise and lower a cable suspended from the head assembly.

4. A frame according to claim 2 wherein the lift means comprises a block and tackle means secured to the head assembly to raise and lower a cable suspended therefrom.

5. A frame according to claim 1 wherein the legs are of double construction, each consisting of an outer leg of hollow cross-section and an inner leg of similar-shaped cross-section slidable within the outer leg.

6. A frame according to claim 5 wherein cable means are secured to and extend between lower portions of the forward legs to prevent those legs from spreading when the frame is in position and loaded.

7. A frame according to claim 5 wherein the inner and outer rear legs are slidably adjustable with respect to each other to enable the length of rear leg to be adjustable to predetermined lengths.

8. A frame according to claim 7 wherein the rear leg is constructed so as to be adjustable to be of a length similar to that of the forward legs and wherein anchor means are secured to the lower end of each of the legs, the anchor means constructed so as to releasably secure the corresponding legs to a portion of a rail.

9. A frame according to claim 5 wherein foot bracket plates are secured to the lower end of each inner leg of the forward legs, the plates being contoured to conform with portions of the rail against which the plates are to bear when the frame is in operation, whereby each inner leg may be removed from and reinserted into each corresponding outer leg.

10. A frame according to claim 1 wherein means are secured to and extend between lower portions of the forward legs to prevent those legs from spreading when the frame is in position and loaded.

11. A frame according to claim 1 wherein foot bracket plates are secured to the lower end of each of the forward legs, the plates being contoured to conform to portions of the rail against which the plates are to bear when the frame is in operation.

12. A frame according to claim 1 wherein anchor means are secured to the lower end of each of the legs, the anchor means constructed so as to releasably secure the corresponding leg to a portion of a rail.

13. A rail bridge rescue frame comprising three elongated legs having upper and lower ends, the upper ends secured to a head assembly so as to universally pivot with respect thereto, two of the legs being forward legs of shorter and similar length and the third being a rear leg of longer length, means secured to the lower end of each of the forward legs to bear against a side portion of a rail and means attached to the lower end of the rear leg for securing to a portion of a rail, the frame constructed so that when the rear leg is secured to one rail of a railway and the lower ends of the forward legs are bearing against outer portions of an adjacent rail, the head assembly will be positioned clear of the railway to one side to provide support for lifting a line to lift a person or object below the railway up to the railway, and wherein the lower end of the rear leg has secured to it a jaw shackle for releasable engagement to a steel cable anchorage sling circumscribing a portion of a rail to which the rear leg is to be attached.

* * * * *